United States Patent [19]

Zimmerly

[11] 4,416,393

[45] Nov. 22, 1983

[54] INFLATOR GUARD

[75] Inventor: Harry L. Zimmerly, Largo, Fla.

[73] Assignee: Halkey-Roberts Corporation, Paramus, N.J.

[21] Appl. No.: 305,038

[22] Filed: Sep. 23, 1981

[51] Int. Cl.[3] ..... B63C 9/24; B67B 7/24

[52] U.S. Cl. ..... 222/5; 222/153; 222/402.11; 441/92

[58] Field of Search ..... 222/5, 402.11, 153; 441/92, 93, 94; 74/531

[56] References Cited

U.S. PATENT DOCUMENTS 3,113,327 12/1963 Cook ..... 441/94

3,809,288 5/1974 Mackal ..... 222/5

*Primary Examiner*—Robert B. Reeves

*Assistant Examiner*—Russell D. Stormer

[57] ABSTRACT

A guard to prevent the inadvertent operation of an inflator for use with an inflatable article, the inflator having a piercing pin which is operated by a manually operated lever. The guard of the invention, which is used instead of the formerly used headed frangible pin which extended through the lever and the body of the inflator on both sides thereof, is of U-shape and is mounted on the body of the inflator so that the broad main part of the guard straddles the lever when the latter is in retracted position, and the legs of the guard tightly pinch the opposite sides of the inflator body between them. The guard is simple and economical to make, can be quickly applied to the inflator body, is reusable, and can readily be applied in the field, in contrast to the formerly employed frangible pin which required the use of special heading equipment in order fully to apply it to the inflator body.

8 Claims, 4 Drawing Figures

INFLATOR GUARD

This invention relates to a guard for the effective prevention of the unintentional operation of a manually operated device for inflating an inflatable article.

The illustrative inflator to which the guard of the invention is shown applied is one shown and claimed in Mackal U.S. Pat. No. 3,809,288, May 7, 1974. In order to prevent accidental operation of such inflator, there has previously been used a frangible plastic pin which is preliminarily headed on one end, the pin being inserted through aligned holes in the body of the inflator on opposite sides of a groove therein, said groove receiving the manually operated lever of the inflator before it is operated. The pin also extends through a hole in the lever, and after insertion in the inflator is the headed at the forward end thereof. Such insertion of the pin and its heading is a time-consuming, and thus costly operation. Further, once broken, by the manual operation of the inflator, the pin cannot be reused, nor can a pin be effectively applied and headed in the field where no heading apparatus such as shown in Mackal et al. U.S. Pat. No. 4,253,812, Mar. 3, 1981, is available.

The present invention has among its objects the replacement of the frangible plastic safety pin for a manual inflator of the type indicated by a novel guard in accordance with the invention. The guard of the invention interfits and cooperates with the body of the inflator, which formerly employed the frangible plastic pin as the guard, without any modification of such body of the inflator or other parts thereof. The guard of the present invention is generally of U-configuration, having a broad main body and two spaced parallel confronting legs connected to the ends of such main body. Upon the inner confronting surfaces of the legs there are disposed aligned part-spherical bosses which snap into and are retained by the outer ends of the holes in the inflator body which formerly received the frangible safety pin. The guard of the invention is made of durable, strong and flexible material which permits flexing thereof as the bosses on the opposite legs are snapped into and out of the holes on the inflator body.

The legs of the guard of the invention fit with in the recesses on the opposite sides of the inflator body wherein the ends of the formerly used safety pin were located, and the main part of the guard projects outwardly to a relatively minor extent beyond the surface of the slotted part of the inflator body which receives the operating lever. The guard of the invention is preferably made of a brightly colored material so that its presence on the inflator can be readily detected.

The invention will be more readily understood upon consideration of the accompanying drawings, in which.

Figure 1:
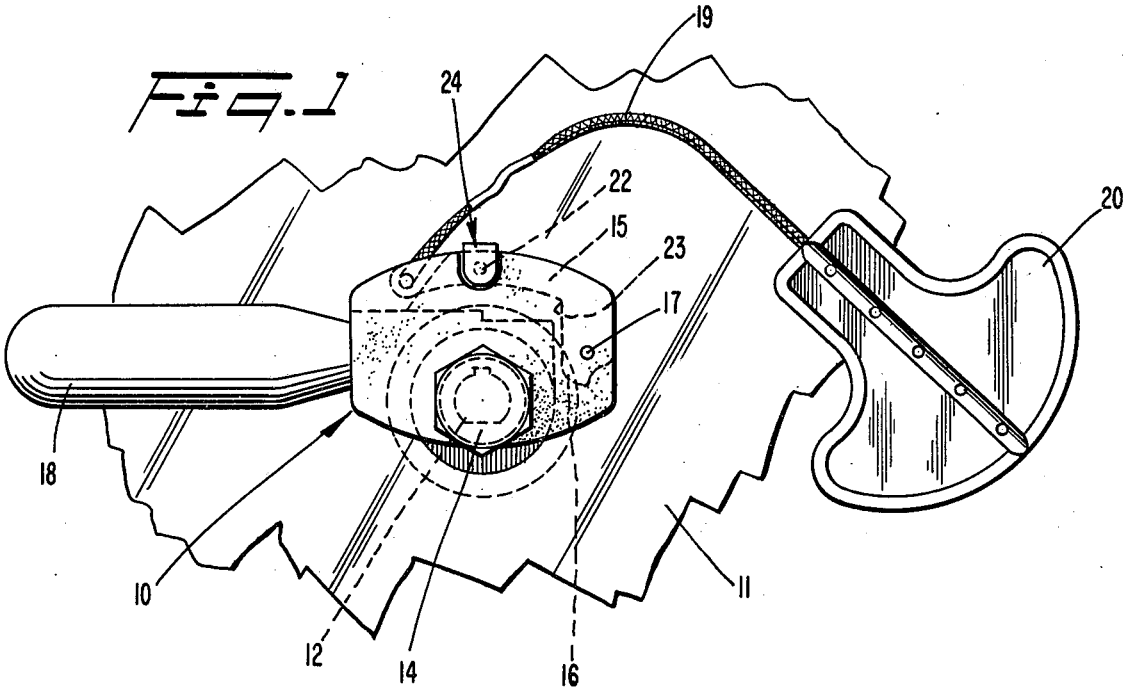
FIG. 1 is a view in side elevation of a manually operated inflator provided with the guard of the invention, the inflator being shown provided with a $CO_2$ cartridge and affixed to a part of the side wall of an inflatable article.
Figure 2:
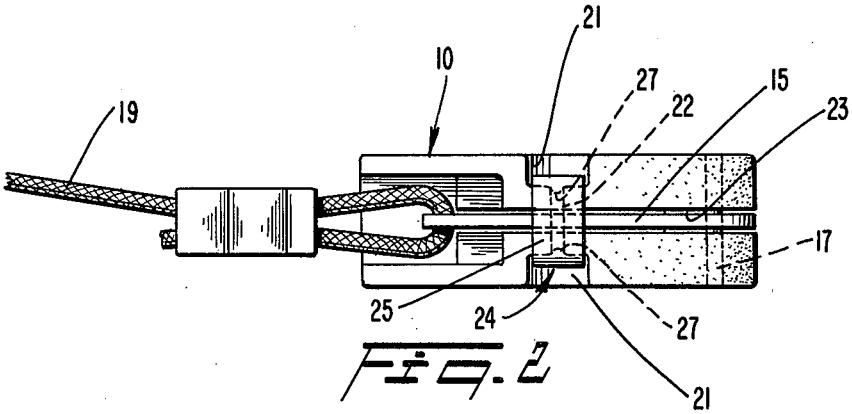
FIG. 2 is a view in plan of the inflator of FIG. 1 with the guard applied thereto.

The illustrative manually operated inflator shown in FIGS. 1 and 2 is generally designated by the reference character 10. Such inflator is shown secured and sealed to a portion 11 of the side wall of an inflatable article, there being a stem generally shown at 12 sealed to the side wall 11, such stem extending through the inflator 10 and secured and sealed thereto by a cap nut 14.

The inflator 10 has a manually operated lever 15 with a cam 16 integral therewith, the lever being turned clockwise (FIG. 1) about a pivot pin 17 upon which the lever is mounted whereby to thrust a piercing pin (not shown) to the left to fracture a sealing means on the end of the neck of a $CO_2$ capsule 18. The thus-released $CO_2$ then flows into the body of the inflator, through the stem 12 and thence into the inflatable article. The lever 15 is thus swung by a lanyard pivotally connected to its outer end, the lanyard having a handle 20 connected thereto.

The body 10 on the inflator has two aligned recesses 21 therein, recesses 21 extending inwardly from opposite sides of the body, as shown. A slot 23 extends longitudinally of the top of the body equidistant between the inner ends of the recesses 21, the slot receiving the lever 15 when it lies as shown in FIGS. 1 and 2.

Substantially centrally of the recesses 21 there are provided aligned holes 22 which formerly received the frangible safety pin employed with the inflator. Now the holes, or at least the outer ends thereof, are employed as an aid for the retention of the guard 24 of the invention.

Figure 3:
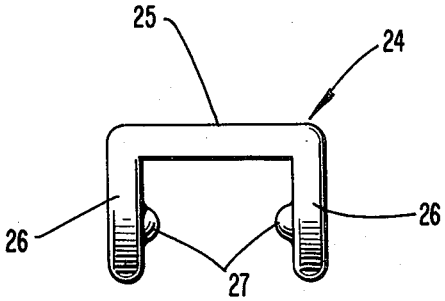
FIG. 3 is a view in end elevation of the guard shown in FIGS. 1 and 2.
Figure 4:
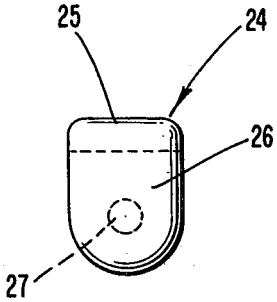
FIG. 4 is a view in side elevation of the guard of the invention.

Guard 24, which is shown in detail in FIGS. 3 and 4, has a top 25 and two spaced parallel legs 26 depending from the ends of such top. On the confronting inner walls of legs 26 there are aligned part-spherical bosses 27. The dimensions of the various parts of guard 24 are such that the legs 26 fit fairly accurately within the recesses 21, the portion 25 thereof straddles the lever 15, and the distance between the central points of the opposed bosses 27 is somewhat less than the distance between the flat parallel surfaces of the opposing recesses 21. As a result, both the legs 26 and the main body 25 of the guard must flex when the guard is applied to the inflator as shown, the central portions of the bosses 27 adjacent the tips thereof snapping into the outer ends of the holes 22 and thus snugly and forcibly retaining the guard in place, as shown in FIGS. 1 and 2.

The guard member 24 may be made of any one of a number of strong resilient and durable materials. It is preferably made of a plastic material, and desirably it has a highly visible color. One such material which can be made is an acetal resin which is made and sold under the TM "DELRIN".

Although the invention is illustrated and described with reference to one preferred embodiment thereof, it is to be expressly understood that it is in no way limited to the disclosure of such preferred embodiment but is capable of numerous modifications within the scope of the appended claims.

I claim:

1. In combination, a manually operated inflator and a guard therefor to prevent the inadvertent operation of the inflator, the inflator having a body, means for mounting on the body a compressed gas containing capsule having a frangible seal, a piercing pin movable toward the seal to pierce it, means thus to move the piercing pin, and a lever pivoted on the body to actuate the piercing pin when a part of the lever is swung outwardly from the body of the inflator, the guard being a generally U-shaped member having a broad main part and parallel legs extending therefrom, the guard being separate from both the body of the inflator and the lever, the broad main part of the guard overlying the retracted part of the lever which is swung out when the inflator is operated, and the legs of the guard forcible engaging opposite sides of the body of the inflator and thus holding the guard in place on the inflator.

2. The combination of claim 1, wherein the sides of the body on opposite sides of the retracted lever have aligned recesses therein, and the legs of the guard fit within said recesses.

3. The combination according to claim 1, wherein the outer sides of the body of the inflator at locations intermediate the length of the retracted lever have aligned depressions therein, and comprising aligned bosses on the confronting inner sides of the legs of the guard, the zones of the bosses adjacent the tips thereof being received within the said depressions in the opposite side walls of the body of the inflator.

4. The combination according to claim 1, wherein the guard is made of strong, tough resilient material.

5. The combination according to claim 4, wherein the guard is made of plastic material.

6. The combination according to claim 5, wherein the guard is made of an acetal resin.

7. In combination, a manually operated inflator and a guard therefor to prevent the inadvertent operation of the inflator, the inflator having a body, means for mounting on the body a compressed gas containing capsule having a frangible seal, a piercing pin movable toward the seal to pierce it, means thus to move the piercing pin, and a lever pivoted on the body to actuate the piercing pin when a part of the lever is swung outwardly from the body of the inflator, the guard comprising a generally U-shaped member having a broad main part and parallel legs extending therefrom, the broad main part of the guard overlying the retracted part of the lever which is swung out when the inflator is operated, and the legs of the guard forcible engaging opposite sides of the body of the inflator and thus holding the guard in place on the inflator, the outer sides of the body of the inflator at locations intermediate the length of the retracted lever having aligned depressions therein, and comprising aligned bosses on the confronting inner sides of the legs of the guard, the zones of the bosses adjacent the tips thereof being received within the said depressions in the opposite side walls of the body of the inflator.

8. The combination according to claim 7, wherein the opposite sides of the body of the inflator have aligned recesses therein receiving the respective legs of the guard, and the depressions on the opposite sides of the body are disposed within said recesses.

* * * * *